US006305904B1

(12) United States Patent
Weigand et al.

(10) Patent No.: US 6,305,904 B1
(45) Date of Patent: Oct. 23, 2001

(54) COOLABLE COMPONENT

(75) Inventors: Bernhard Weigand, Filderstadt-Sielmingen; Klaus Semmler, Lauchringen, both of (DE)

(73) Assignee: ABB Alstom Power (Schweiz) AG, Baden (CH)

( * ) Notice: Subject to any disclaimer, the term of this patent is extended or adjusted under 35 U.S.C. 154(b) by 0 days.

(21) Appl. No.: 09/551,534

(22) Filed: Apr. 18, 2000

(30) Foreign Application Priority Data

Apr. 21, 1999 (EP) ..... 99810329

(51) Int. Cl.[7] ..... B63H 1/14
(52) U.S. Cl. ..... 416/97 R; 416/96 A
(58) Field of Search ..... 416/97 R, 96 R, 416/96 A; 415/115, 116

(56) References Cited

U.S. PATENT DOCUMENTS 3,527,543 9/1970 Howald .

FOREIGN PATENT DOCUMENTS 44 30 302 2/1996 (DE) .
196 54 115 6/1998 (DE) .
0 750 957 1/1997 (EP) .
624939 6/1949 (GB) .
2 117 455 10/1983 (GB) .
410196304-A * 7/1998 (JP) .

* cited by examiner

*Primary Examiner*—Edward K. Look
*Assistant Examiner*—James M McAleenan
(74) *Attorney, Agent, or Firm*—Burns, Doane, Swecker & Mathis, L.L.P.

(57) ABSTRACT

Pins (23) consisting of a material having high thermal conductivity are introduced, alternately with blow-out orifices (22) for a coolant (9), into the material, to be cooled, of a component (141), in such a way that said pins project out of the component on the cooling side (12) of the latter. These pins are cooled in the region which projects out of the component whilst heat is supplied to them in the region which is embedded in the component. The alternating arrangement with blow-out orifices ensures that the flow (7) passes around the pins. This point is important particularly when the pins are arranged in a narrow gap, such as occurs especially in the cooling of the trailing edges of gas turbine blades. The necessary number of blow-out orifices and therefore the coolant consumption is reduced.

13 Claims, 5 Drawing Sheets

COOLABLE COMPONENT

FIELD OF THE INVENTION

The present invention relates to a coolable component which is in contact with a hot gas and cold gas during operation thereof.

BACKGROUND OF THE INVENTION

The efficient cooling of thermally highly loaded components of a gas turbine is an indispensable condition for operating modern machines. There have accordingly been rapid developments in cooling methods.

The simplest form of cooling is convection cooling, in which a cooling medium flows over one surface of a component and extracts heat from the latter, whilst another surface is subjected to the introduction of heat. One disadvantage of convection cooling is, in particular, that the entire heat to be discharged has to be transported through the component wall. The surface subjected to the introduction of heat is at a substantially higher temperature than the cooled surface. Moreover, considerable temperature gradients through component walls and therefore also thermal stresses are caused.

Film cooling, known from U.S. Pat. No. 3,527,543 has therefore been preferred for a long time, in which a coolant—preferably air extracted from the compressor or steam—flows through the component wall from a cold-gas side to the hot-gas side subjected to hot gas. In this case, on the one hand, the coolant absorbs heat from the material while it is flowing through the blow-out orifices. On the other hand, a film of relatively cool medium is laid over the hot-gas side of the component and protects this side from direct contact with the hot medium. However, if film cooling is adopted completely in modern gas turbines, the coolant consumption rises excessively.

Development has therefore tended, to an increased extent, toward using the coolant prior to blow-out for efficient convection cooling. In impact cooling, which may be gathered, from DE 44 30 302, for example, the coolant impinges at as high a velocity as possible onto the component to be cooled, thereby intensifying the convective transmission of heat from the component to the coolant. However, the good cooling effect is achieved at the expense of comparatively high pressure losses on the cooling side.

Furthermore, impact cooling cannot readily be used everywhere. Problems arise particularly in the region of the blade trailing edges due to the geometric design. On the other hand, it is precisely there where good cooling of the material is necessary, since, in comparison with the material thickness, the surface exposed to the hot gas is large, whereas the surface of the cold-gas side is relatively small. Furthermore, it has been shown, in practice, that there are, in fact, major problems, in a closed structure, in achieving a flow through such narrow gaps as are present on the cooling side in the region of the trailing edge. In this region, the inner walls of the hollow component butt against one another at an acute angle, and the flow boundary layers on the cooling side coalesce. The flow velocity in the narrow gap becomes very low, and the coolant flow is displaced into other parts of the component interior. The displacement action of the flow boundary layers thus place narrow limits on any improvement in the convective cooling effect.

The most common and most reliable method for cooling the blade trailing edges of at least air-cooled gas turbines has hitherto been trailing-edge blow-out which is very closely akin to film cooling and is often somewhat inaccurately also included in this collective term. In this method, coolant flows out through a number of orifices in the trailing edge and at the same time absorbs heat from the material of the blade. Introducing the blow-out orifices into the trailing edge gives rise to convection through the narrow cooling gap, in such a way that abovementioned displacement phenomena do not occur. On the other hand, the center distance between two cooling orifices at the trailing edge should be very small and, if possible, not exceed eight hydraulic diameters of the orifices. This design directive ensures that, when conventional blade materials are used, the temperature variation along the blade trailing edge remains within an acceptable scope, and local overheating phenomena are avoided. Thus, in the blow-out orifices taken as a whole, trailing-edge blow-out affords a large flow cross-section and contributes considerably to the consumption of coolant which it is expedient to minimize with a view to an increase in efficiency.

The situation thus arises where special fluidic conditions inside a turbine blade restrict the use of convective cooling methods for trailing-edge cooling. By contrast, because of the coolant consumption, trailing-edge blow-out has adverse effects on the efficiency of the gas turbine circulation process.

DE 196 54 115 therefore proposes to dispense with trailing-edge blow-out in the cooling of blade trailing edges and, instead, to introduce thermally highly conductive pins into the trailing-edge material, said pins projecting into the blade interior through which coolant flows. Consequently, heat is to be transported out of the trailing-edge material and transferred to the cooling-air flow. In this case, the pins, when cooled sufficiently by the coolant, act as heat sinks in the basic material of the blade. Here, too, however, there is again the problem, already discussed, that the flow boundary layers coalesce in the region of the trailing edge at the inner walls which taper at an acute angle, and the cooling flow is displaced into other regions of the blade interior. The pins further increase the obstruction of the cooling duct, and ultimately the cooling air does not flow around them to the desired extent, so that transmission of heat from the pins to the cooling medium is restricted and a suboptimal heat-sink effect of the pins is obtained as a result.

SUMMARY OF THE INVENTION

This is where the invention comes into play. In a coolable component consisting of a basic material the transmission of heat from the pins to the cooling medium is to be improved, said component is in contact during operation, on a hot-gas side, with a first flowing medium and, on a cold-gas side, with a second flowing medium, the temperature of the first medium being higher than that of the second medium, in such a way that the component is heated by the first medium and cooled by the second medium, and the basic material of the component surrounding pins, which pins project out of the cold-gas side into the flow of the second medium and consist of a material, the thermal conductivity of which is higher than that of the basic material used for producing the component, in such a way that, during operation, the pins act as heat sinks in the basic material.

This is achieved, according to the invention, in that the component has blow-out orifices, through which, during operation, at least part of said second medium flows from the cold-gas side to the hot-gas side, in such a way that the blow-out orifices likewise act as heat sinks, and in that at least one pin and at least one orifice is arranged in each case along at least one line on the cold-gas side. In the case of a corresponding pressure gradient between the two. flow media, the additional introduction of blow-out orifices results, even in an narrow gap, in a forced convection flow which guides coolant around the pins.

The essence of the invention is therefore, on the one hand, to guide the heat out of the material by means of thermally highly conductive pins, instead of via the coolant flowing through the blow-out orifices, in order thereby to restrict the coolant consumption. The restriction of the coolant consumption has a very positive effect on efficiency precisely when compressor air is used for cooling purposes. Expediently, in this case, the pins are arranged along lines running on the cold-gas side, in a similar way to the arrangement of the blow-out orifices in film cooling. On the other hand, the fluidic boundary conditions in a closed cooling system within a component, for example during the cooling of a blade trailing edge, prevent a good convective transmission of heat from the pins to the coolant, even though this is a condition for the functioning of the cooling device. The heat-conducting pins therefore have introduced between them blow-out orifices which, in turn, perform part of the cooling, but, on the other hand, ensure a good flow around the pins and a discharge of the convectively heated coolant. In this case, the cooling effect is increased even beyond the extent of each individual cooling method considered in itself, because the flow passes intensively around the pins in their longitudinal direction and also radially. The effect may be further improved if guide means arranged on the cold-gas side direct the coolant, flowing to the blow-out orifices, via the heat-conducting pins.

When the cooling configuration according to the invention is used, therefore, fewer orifices are required than in straightforward cooling by blow-out, with the result that the consumption of coolant is lowered. Since, on the other hand, the heat conducting pins extract heat from the material, that is to say the heat sink distribution in the component is kept constant, the temperature distribution in the component does not become more uneven.

The arrangement of blow-out orifices and heat-conducting pins may take place according to different criteria and in the individual case will, of course, require a detailed calculation of the temperature distribution in the machine component. For the geometric arrangement of the pins and orifices in relation to one another, it will prove suitable to arrange a number of alternately arranged pins and orifices in a line, in a similar way to the arrangement of the blow-out orifices in rows. For a minimized coolant consumption, the alternating arrangement of two pins and one blow-out orifice in each case will certainly prove suitable, the orifice expediently being arranged centrally between two pins. By contrast, in order to achieve as homogeneous a temperature distribution as possible, the alternating arrangement of one pin and one orifice in each case will be preferable. In this context, an equidistant arrangement of pins and orifices will likewise contribute, in most cases, to minimizing the temperature differences within the component in terms of a predetermined overall blow-out cross section. A uniform temperature distribution in the component section to be cooled, as described, will be encouraged if the distance between two heat sinks is no more than eight hydraulic diameters of a blow-out orifice. In the same regard, the pins should be arranged with their longitudinal axes more or less parallel to the blow-out orifices, so that the heat flow always runs in the same direction.

In order to achieve the desired effect, the thermal conductivity of the material of which the pins consist must be as high as possible and have at least three times the value of the basic material. The melting point of the material must, of course, also be sufficiently high. Materials which come under consideration for the production of the heat-conducting pins are, for example, tungsten, silver or, in particular, diamond. The pins must have as good a transmission of heat as possible to the basic material, and this can be achieved by casting them integrally in the components. At the same time, however, they should in no way penetrate the complete material thickness of the component from the cold-gas side to the hot-gas side, so as not to give rise to any adverse heat bridge. Advantageously, the pins are introduced into the basic material to a depth corresponding to 30% to 80% of the material thickness. This, on the one hand, ensures a large heat exchange surface and, on the other hand, avoids the formation of thermal bridges. Furthermore, the heat-conducting pins must, of course, project into the coolant to some axial extent.

As set forth in the introduction, the cooling configuration according to the invention exhibits its specific advantages particularly when used in hollow components, in the interior of which there is provision for the throughflow of a cooling medium, specifically, in particular, where component walls meet at an acute angle. This configuration is sound, in particular, at the trailing edges of gas turbine blades.

Furthermore, the cooling configuration according to the invention is to be used advantageously in the cooling of blade platforms. There, on the one hand, the pins assist in discharging heat from the very solidly built platforms, without causing an excessive rise in the cooling-air consumption. At the same time, the cooling configuration according to the invention can advantageously also be combined with impact cooling.

BRIEF DESCRIPTION OF THE DRAWINGS

The invention will be explained below with reference to exemplary embodiments illustrated in the drawing in which, in particular.

DETAILED DESCRIPTION OF THE INVENTION

Figure 1:
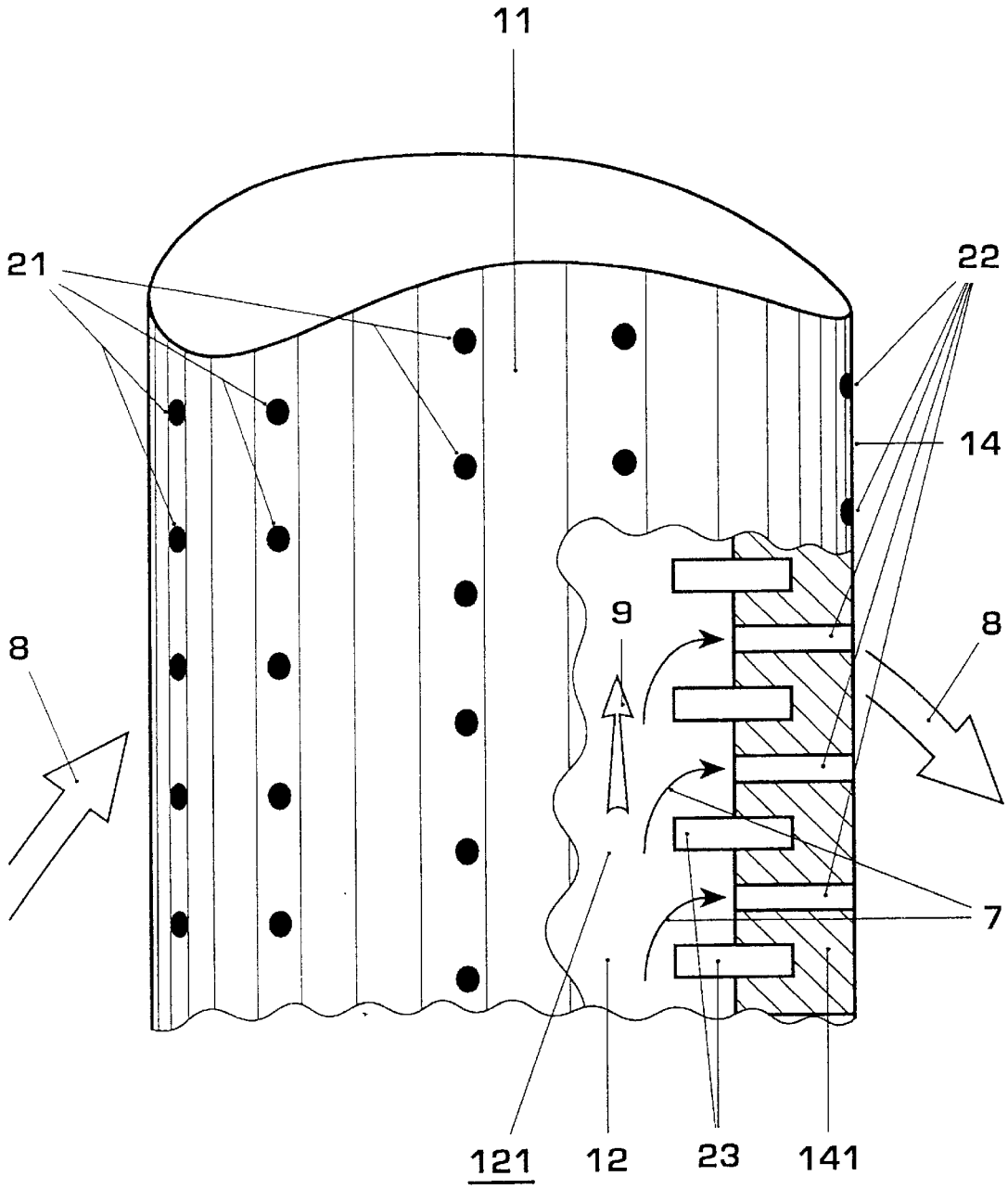
FIG. 1 shows a first preferred embodiment of the invention for cooling the trailing edge of a gas turbine blade

The exemplary embodiments illustrated in the drawing are merely of an instructive nature and are not to serve for circumscribing the subject of the invention. The invention is not delimited either by the special embodiments illustrated or by the uses in connection with which it is illustrated below, but, on the contrary, the following examples disclose to the average person skilled in the art a multiplicity of other possibilities of use and forms of design of the invention defined in the claims.

Figure 2:
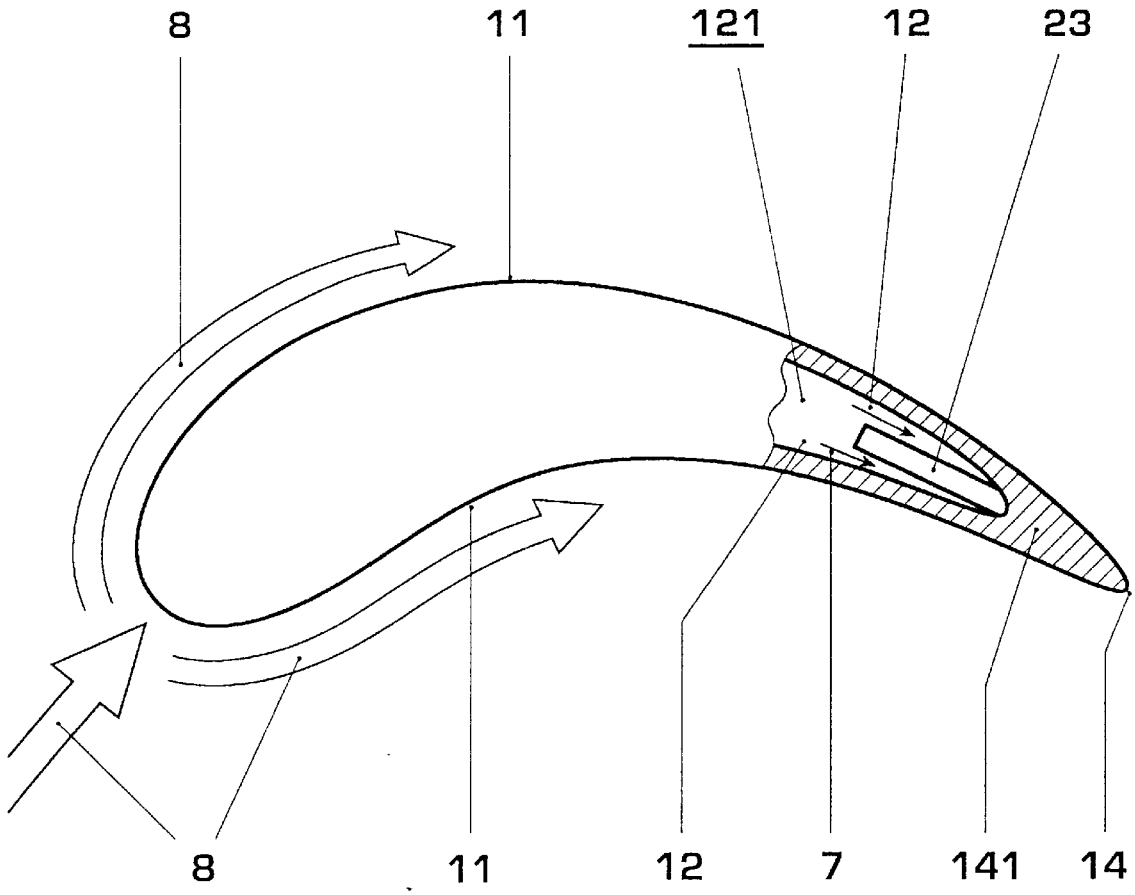
FIG. 2 shows a top view of the gas turbine blade illustrated in FIG. 1

A first preferred version of the invention is illustrated in two views in FIGS. 1 and 2. The hollow-cast turbine blade has flowing around it, during operation, a hot-gas flow 8 which causes heat to be introduced into the material of the blade via the hot-gas side 11. In present-day gas turbines, the temperature of the hot gas considerably exceeds the material temperature permitted in the case of a given mechanical load. The functioning of such a turbine blade can therefore be ensured only by means of sufficient cooling. For this reason, the blade is cooled from its cold-gas side 12 by the coolant 9. Inside the blade there may be various fittings, such as impact-cooling plates or webs for guiding the coolant on the cold-gas side.

It may be noted, with regard to the nomenclature, that the present description and the claims adopt the terms "cold-gas side" and "hot-gas side" for the sake of simplicity. It must be understood, however, that this does not in fact represent any restriction and does not explicitly rule out cases in which nongaseous media flow over the component surfaces. On the contrary, it is important to use simple, succinct terms which are familiar to the person skilled in the art and from which he understands that one surface is in contact with a first medium and a second surface is in contact with another medium, which media are at different temperatures, the person skilled in the art immediately inferring where the relatively hotter or respectively colder medium is located. The designation "hot-gas flow" to the same extent does not explicitly rule out a flow of a nongaseous medium of high temperature. Moreover, the person skilled in the art may readily gather the meaning of the relative terms "hot" and "cold" from the context.

Rows of blow-out orifices 21 can be seen on the surface of the blade on lines running essentially perpendicularly to the direction of flow of the hot gas. On the one hand, coolant flowing through these orifices absorbs heat from the material; on the other hand, if the blow-out orifices 21 are arranged and designed appropriately, the cooler blow-out flow is laid as an insulating layer over the hot-gas side 11 of the blade and partially insulates the latter against the hot-gas flow 8.

The shape and size of the blow-out orifices 21 and also their distance from one another are not essential to the invention, and the selected illustration should in no way be understood in a restricting sense.

The top view of the blade, as illustrated in FIG. 2, shows particularly clearly a material accumulation 141 in the region of the trailing edge 14 and the interior 121 which narrows sharply near the trailing edge. This material accumulation is at great risk of overheating. On the one hand, the blade is very thin in this region. The surface on the hot-gas side 11 is substantially larger in the trailing-edge region than the surface on the cold-gas side 12. Moreover, such a material accumulation, where pronounced local temperature differences may potentially occur, is at extreme risk of thermal stress cracks. On account of the special geometric boundary conditions in the trailing-edge region, the heat has to be literally transported out of the material accumulation. This purpose is served, on the one hand, by a row of blow-out orifices 22 which is arranged along the trailing edge. A coolant quantity 7 flowing through these absorbs heat from the material accumulation 141 and transports it away outward. In this respect, the blow-out orifices 22 are heat sinks. So as not to allow the temperature differences along the trailing edge to increase excessively and to avoid local overheating, the distance between the heat sinks should not exceed a particular maximum amount. As a rule of thumb for a design criterion, it is specified that the distance between two blow-out orifices 22 should not exceed eight hydraulic diameters of a blow-out orifice. This initially results in a large number of blow-out orifices and therefore in a high mass blow-out flow at the blade trailing edge. In order to avoid this, according to the invention, at least one pin 23, exactly one in this first example, consisting of a material having high thermal conductivity, which should be at least three times as high as the thermal conductivity of the blade material, is introduced into the material accumulation 141 in each case between two blow-out orifices 22 on the trailing edge, said pin serving as an additional heat sink. Preferably, each heat-conducting pin projects into the blade interior over two to twenty pin diameters and has as good a contact as possible with the blade material. The latter feature can be implemented by the pin being integrally cast during the casting of the blade. In this case, they must be embedded in the blade material over a particular length, but without penetrating through this, since they otherwise produce a harmful thermal bridge between the hot-gas side 11 and the cold-gas side 12 of the blade. It will prove beneficial if the pins are embedded in the blade material to a depth which corresponds to between 30% and 80% of the total material thickness, whilst the most favorable dimension will have to be determined in the individual case by means of numerical simulation of the heat flows.

With a view to advantageous temperature distribution, the pins are arranged in such a way that their longitudinal axes run more or less parallel to the blow-out orifices. It is beneficial, furthermore, if a number of heat-conducting pins and blow-out orifices are arranged approximately in a line along the blade trailing edge. This proves favorable particularly in terms of ensuring a good flow of coolant around the pins, which, of course, is a necessary condition for the heat-conducting pins to function as heat sinks.

Here, in fact, the situation is such that the cooling-air flow 9 builds up boundary layers on the cold-gas side 12 of the blade walls and that the boundary layers, which are built up on opposite walls, converge in the narrow channel in the trailing edge region and displace the coolant flow 9 out of this region of the blade interior 121. The displacement action is further enforced by the pins. For this reason, in an arrangement, as proposed by DE 194 54 115, the convective transmission of heat between the heat-conducting pins and the coolant is relatively low, with the result that the heat-conducting pins perform their function as heat sinks in the blade trailing edge suboptimally.

In the configuration proposed here, the trailing-edge blow-out orifices 22 induce forced convection in the narrow cooling gap, and the heat-conducting pins, when suitably arranged, have the blow-out streams 7 flowing around them and are cooled. The close interdependence of the trailing-edge blow-out and heat-conducting pins is shown here.

Figure 3:
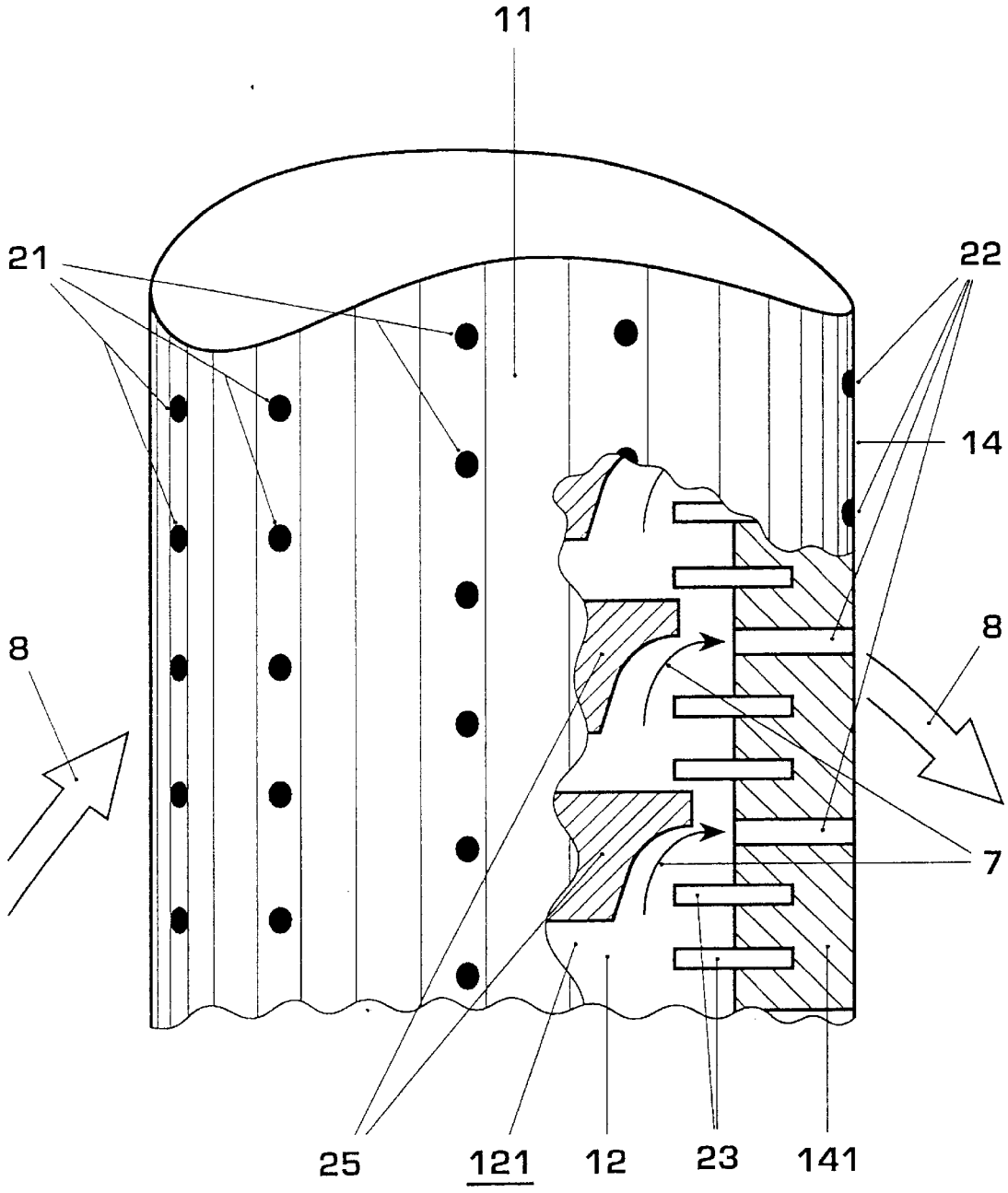
FIG. 3 shows a further preferred embodiment of the invention for cooling the trailing edge of a gas turbine blade

A further preferred embodiment is shown in FIG. 3. Here, two heat-conducting pins are arranged in each case between two blow-out orifices. The coolant consumption is thereby further reduced, as compared with the geometry illustrated in FIG. 1. In FIG. 3, furthermore, flow guide means 25 guiding the blow-out air stream 7 via the heat-conducting pins are introduced in the blade interior. Measures of this kind may, of course, also be expedient in a configuration corresponding to that of FIG. 1. The coolant may also be led to the trailing edge by means of corresponding turbulators in the main cooling channel.

Irrespective of the specific configuration selected in the execution of the invention, care must advantageously to be taken, at least in use on blade trailing edges, to ensure that the distance between two heat sinks is selected no greater than eight hydraulic diameters of a trailing-edge blow-out orifice. In this respect, the preferred cross-sectional surface of the pins, which is between one and ten cross-sectional surfaces of a blow-out orifice, may also be mentioned.

Figure 4:
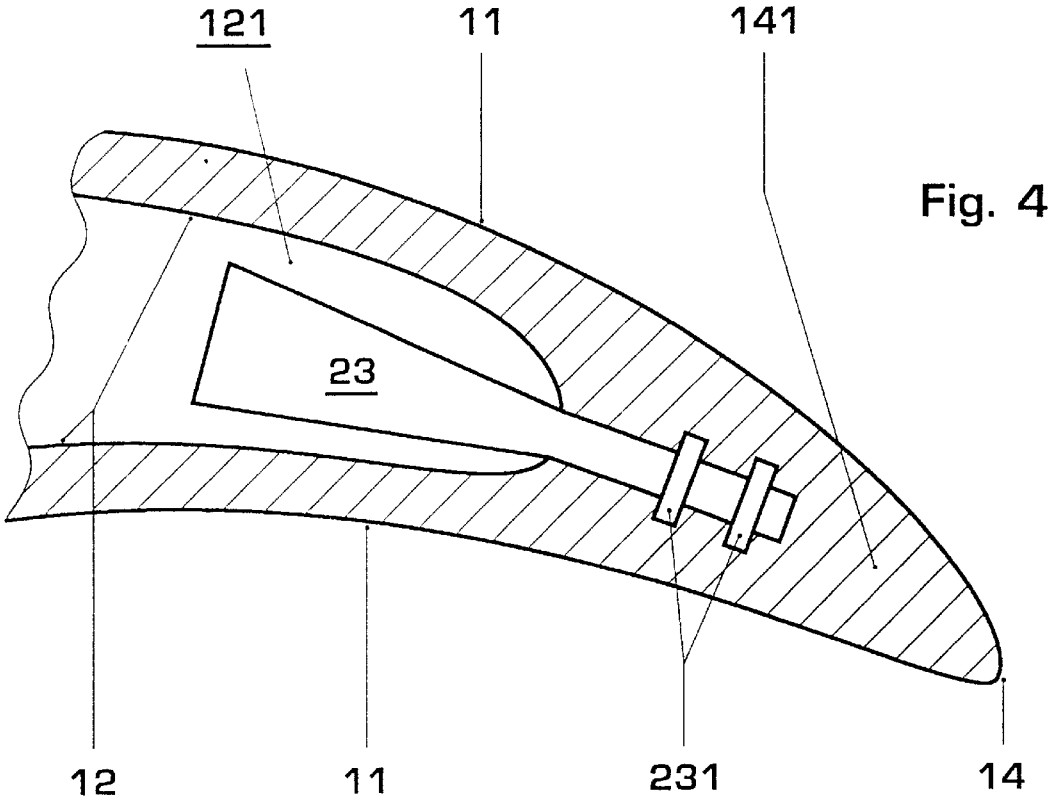
FIGS. 4 and 5 show examples of possible variants in the design of the heat-conducting pins
Figure 5:
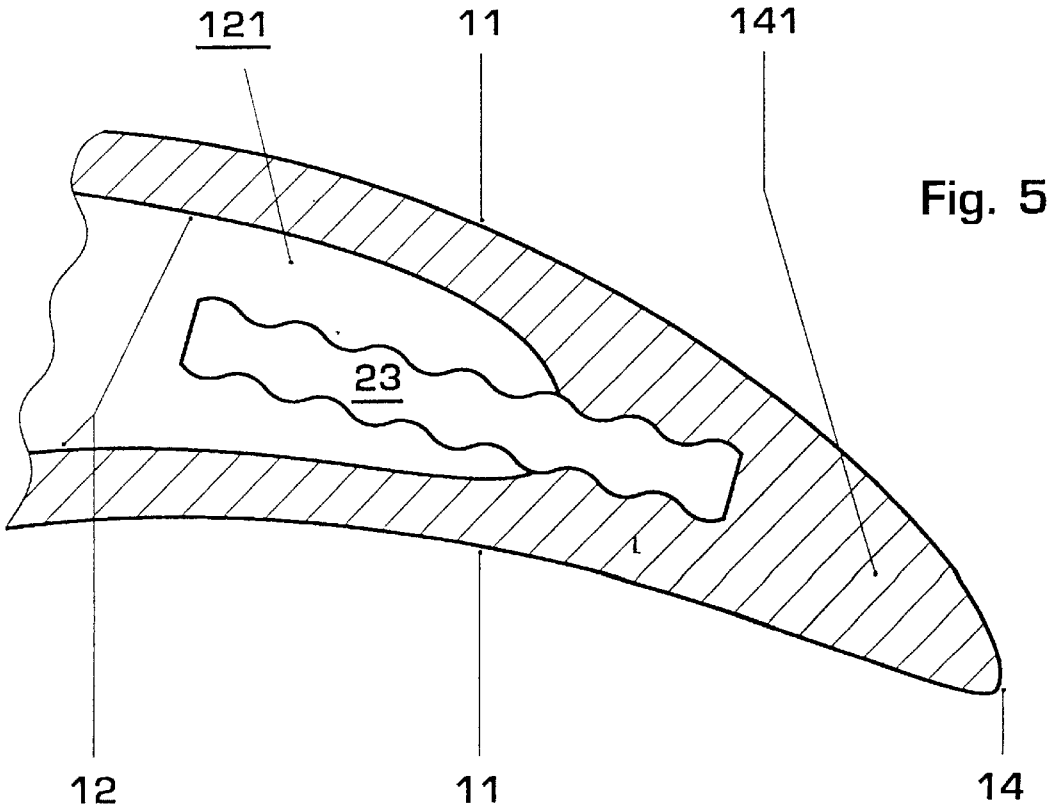

The shape of the heat-conducting pins may be varied within wide limits. Thus, for example, a round cross section is in no way mandatory. It is expedient, however, under all circumstances, to select the extent along a longitudinal axis to be markedly greater than the extent in the other directions. The shape of the heat-conducting pins will be determined primarily by the manufacturing method, and a cylindrical pin can be obtained particularly easily by cutting off a wire. However, the flow around the pin and the heat exchange surface may be modified by the deliberate configuration of, for example, that part of the pin which projects into the coolant. Two examples of possible geometries are illustrated in FIGS. 4 and 5. The form of construction shown in FIG. 4, due to the conical shape, keeps the throughflow cross section between the pin 23 and the cooling-side component walls 12 largely constant. Brackets 231 increase the heat exchange surface between the basic material 141 and the heat-conducting pin 23 and improve the fixing of the pin in the basic material. The corrugated form of construction shown in FIG. 5 likewise increases the heat exchange surface both on the material side and on the coolant side.

Figure 6:
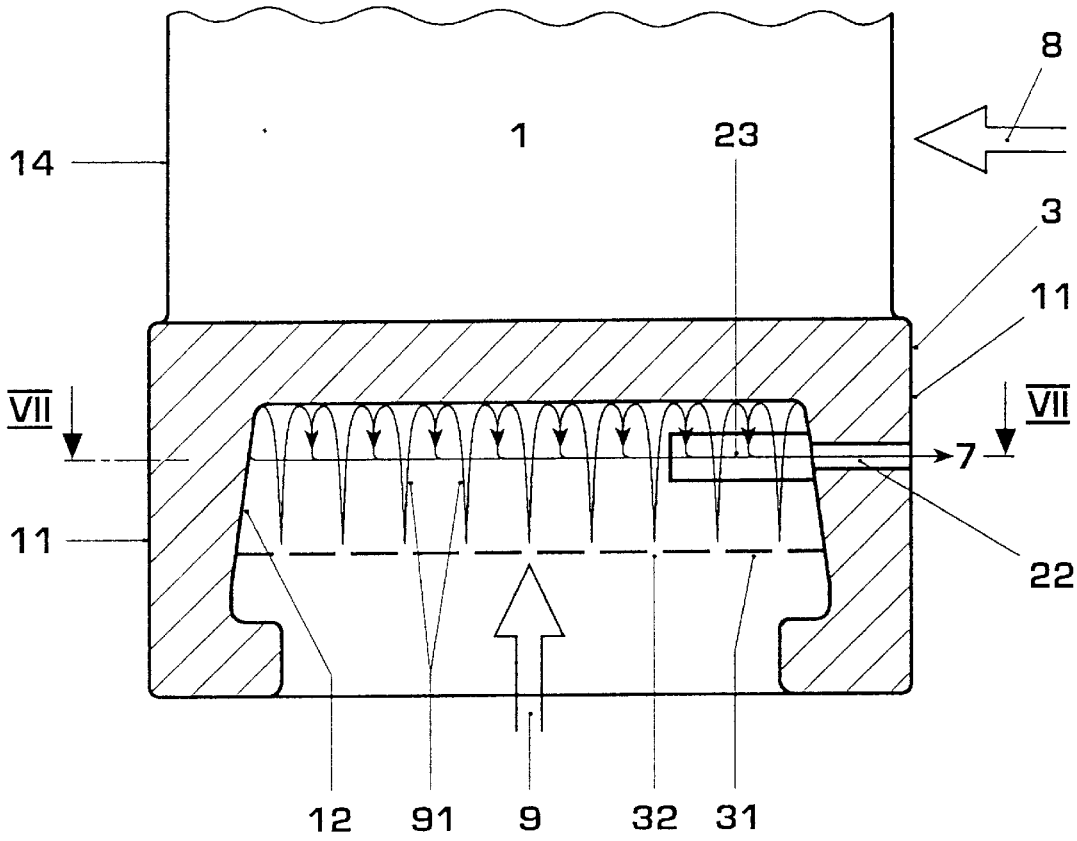
FIG. 6 shows a further example of the use of the invention in cooling a platform edge.

In a further preferred embodiment shown in FIG. 6, a blade platform 3 carries a blade leaf 1. A hot-gas flow 8 flows onto the entire configuration. The blade leaf is cooled in any desired way known per se, the cooling of and the supply of coolant to the blade leaf not being taken into account in the figure. Coolant 9 flows into the hollow blade platform and impinges onto an impact cooling insert 31. The coolant flows through orifices in the impact cooling insert 32. Coolant jets 91 impinge at high velocity onto the cold-gas side 12 of the platform, where intensive convection heat exchange takes place. The coolant is subsequently discharged through blow-out orifices 22. Once again, as can be seen clearly in the section illustrated in FIG. 7 and taken along the line VII—VII, heat-conducting pins 23 and blow-out orifices 22 are arranged alternately essentially in a line along the platform leading edge, in such a way that the blow-out stream 7 flows first around the heat-conducting pins and finally through the blow-out orifices. Some of the orifices of the impact cooling insert are otherwise not illustrated in this top view for the sake of clarity.

Figure 7:
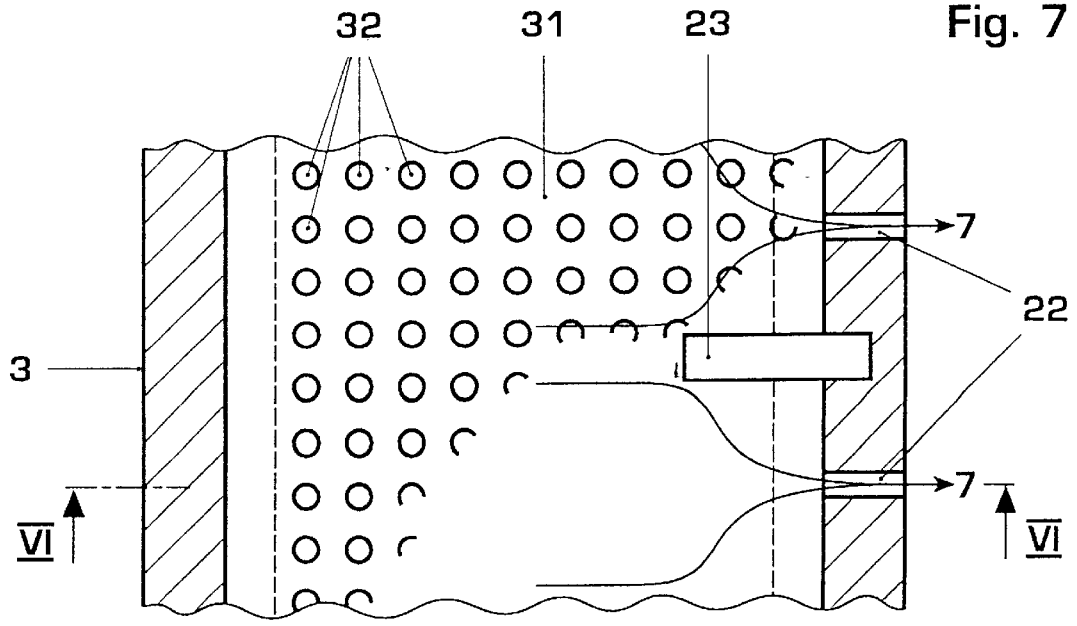
FIG. 7 shows a section along the line VII—VII depicted in FIG. 6.

The cooling, according to the invention, of the platform edge may, of course, also be combined with the features specified above, such as the shape of the heat-conducting pins or the flow guide means. What remains to be mentioned, moreover, is that the impact cooling illustrated in the exemplary embodiment in FIGS. 6 and 7 is optional, even though it expediently contributes to utilizing the coolant particularly efficiently.

Although this invention has been illustrated and described in accordance with certain preferred embodiments, it is recognized that the scope of this invention is to be determined by the following claims.

What is claimed is:

1. A coolable component, comprising:

a first material;

a hot-gas side, said hot-gas side being in contact with a first flowing medium during operation;

a cold-gas side, said cold-gas side being in contact with a second flowing medium during operation;

the temperature of the first flowing medium being higher than that of the second flowing medium, such that the component is heated by the first flowing medium and cooled by the second flowing medium, during operation;

a plurality of pins surrounded by the first material of the component, said pins projecting out of the cold-gas side into the flow of the second flowing medium, during operation and comprising a material with a higher thermal conductivity than that of the first material used for producing the component, such that, during operation, the pins act as heat sinks in the first material;

a plurality of blow-out orifices, through which, during operation, at least part of said second flowing medium flows from the cold-gas side to the hot-gas side, such that the blow-out orifices likewise act as heat sinks, and wherein at least one pin and at least one orifice are in each case arranged alternately along at least one line at the cold-gas side.

2. The coolable component as claimed in claim 1, wherein at least a number of alternately arranged pins and orifices are arranged in one row.

3. The coolable component as claimed in claim 1, wherein the pins comprise a material, the thermal conductivity of which has at least three times the value of the thermal conductivity of the first material.

4. The coolable component as claimed in claim 1, wherein the distance between two heat sinks is smaller than eight times the hydraulic diameter of a blow-out orifice.

5. The coolable component as claimed in claim 1, wherein said orifices and pins are at approximately identical distances from one another.

6. The coolable component as claimed in claim 1, wherein the pins project into the first material of the component over between 30% and 80% of a local material thickness, as measured in the longitudinal direction of the pins.

7. The coolable component as claimed in claim 1, wherein each of the pins projects at least twice as far into the second flowing medium as corresponds to the dimension obtained from the square root of the cross-sectional surface of a pin at the point of penetration into the cold-gas side.

8. The coolable component as claimed in claim 1, wherein the cold-gas side has arranged thereon, means which guides the medium flowing through the blow-out orifices through the pins.

9. The coolable component as claimed in claim 1, wherein the pins run parallel to the blow-out orifices.

10. The coolable component as claimed in claim 1, wherein the pins are cast in the component.

11. The coolable component as claimed in claim 1, wherein the component is a hollow body, the hot-gas side being located on the outside and the cold-gas side being located on the inside of said hollow body, respectively.

12. The coolable component as claimed in claim 11, wherein the component is a gas turbine blade, and the pins and the blow-out orifices are arranged along at least one line on the cold-gas side of a blade platform of the gas turbine blade.

13. The coolable component as claimed in claim 11, wherein the component is a gas turbine blade, and wherein the blow-out orifices and pins are arranged along a trailing edge of the blade, and the pins project into the interior of the gas turbine blade.

* * * * *